US007520315B2

(12) United States Patent
Hou et al.

(10) Patent No.: US 7,520,315 B2
(45) Date of Patent: Apr. 21, 2009

(54) HEAT PIPE WITH CAPILLARY WICK

(75) Inventors: Chuen-Shu Hou, Tu-Cheng (TW); Tay-Jian Liu, Tu-Cheng (TW); Chao-Nien Tung, Tu-Cheng (TW); Chih-Hsien Sun, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 169 days.

(21) Appl. No.: 11/309,245

(22) Filed: Jul. 19, 2006

(65) Prior Publication Data

US 2007/0193722 A1 Aug. 23, 2007

(30) Foreign Application Priority Data

Feb. 18, 2006 (CN) ..... 2006 1 0033847

(51) Int. Cl.
*F28D 15/04* (2006.01)
*F28F 13/08* (2006.01)

(52) U.S. Cl. ..... 165/104.26; 165/146

(58) Field of Classification Search ..... 165/104.26, 165/146

See application file for complete search history.

(56) References Cited

U.S. PATENT DOCUMENTS 3,754,594 A 8/1973 Ferrell
4,116,266 A * 9/1978 Sawata et al. ..... 165/104.26
4,489,777 A * 12/1984 Del Bagno et al. ..... 165/104.26
6,315,033 B1 11/2001 Li
6,997,243 B2 * 2/2006 Hsu ..... 165/104.26
6,997,244 B2 * 2/2006 Hul-Chun ..... 165/104.26
7,124,810 B2 * 10/2006 Lee et al. ..... 165/104.26
7,134,485 B2 * 11/2006 Hul-Chun ..... 165/104.26
7,137,442 B2 * 11/2006 Kawahara et al. ..... 165/104.26
2003/0141045 A1 * 7/2003 Oh et al. ..... 165/104.26
2004/0040696 A1 * 3/2004 Cho et al. ..... 165/104.26

FOREIGN PATENT DOCUMENTS

CN 2613740 Y 4/2004
CN 2735283 Y 10/2005
JP JP58-35388 A 3/1983

* cited by examiner

*Primary Examiner*—Leonard R Leo
(74) *Attorney, Agent, or Firm*—Frank R. Niranjan

(57) ABSTRACT

A heat pipe includes a casing (100) containing a working fluid therein and a capillary wick (200) arranged in an inner wall of the casing. The casing includes an evaporating section (400) at one end thereof and a condensing section (600) at an opposite end thereof, and a central section (500) located between the evaporating section and the condensing section. The thickness of the capillary wick formed at the condensing section is smaller than that of the capillary wick formed at the central section in a radial direction of the casing. The capillary wick is capable of reducing the thermal resistance between the working fluid and the casing at the condensing section.

5 Claims, 5 Drawing Sheets

HEAT PIPE WITH CAPILLARY WICK

FIELD OF THE INVENTION

The present invention relates generally to apparatuses for transfer or dissipation of heat from heat-generating components such as electronic components, and more particularly to a heat pipe having a graduated thickness of capillary wick.

DESCRIPTION OF THE RELATED ART

Heat pipes have excellent heat transfer properties, and therefore are an effective means for the transference or dissipation of heat from heat sources. Currently, heat pipes are widely used for removing heat from heat-generating components such as the central processing units (CPUs) of computers. A heat pipe is usually a vacuum casing containing a working fluid therein, which is employed to carry thermal energy from one section of the heat pipe (typically referred to as an evaporating section) to another section thereof (typically referred to as a condensing section) under phase transitions between a liquid state and a vapor state. Preferably, a wick structure is provided inside the heat pipe, lining an inner wall of the casing, drawing the working fluid back to the evaporating section after it is condensed in the condensing section. Specifically, as the evaporating section of the heat pipe is maintained in thermal contact with a heat-generating component, the working fluid contained at the evaporating section absorbs heat generated by the heat-generating component and then turns into vapor. As a result, due to the difference of vapor pressure between the two sections of the heat pipe, the generated vapor moves towards and carries the heat simultaneously to the condensing section where the vapor is condensed into liquid after releasing the heat into ambient environment, for example by fins thermally contacting the condensing section, where the heat is then dispersed. Due to the difference of capillary pressure developed by the wick structure between the two sections, the condensed liquid is then drawn back by the wick structure to the evaporating section where it is again available for evaporation.

FIG. 5 shows an example of a heat pipe in accordance with related art. The heat pipe includes a metal casing 10 and a single layer capillary wick 20 of uniform thickness attached to an inner surface of the casing 10. The casing 10 includes an evaporating section 40 at one end and a condensing section 60 at the other end. An adiabatic section 50 is provided between the evaporating and condensing sections 40, 60. The adiabatic section 50 is typically used to encourage transport of the generated vapor from the evaporating section 40 to the condensing section 50. The thickness of the capillary wick 20 is uniformly arranged against the inner surface of the casing 10 from its evaporating section 40 to its condensing section 60. However, this singular and uniform-type wick 20 generally cannot provide optimal heat transfer for the heat pipe because it cannot simultaneously produce a large capillary force and a low thermal resistance. The evaporating and condensing sections 40, 60 of the heat pipe have different demands due to different functions. The thermal resistance between the working fluid and the condensing section 60 of the heat pipe is large due to the uniform thickness of the capillary wick 20. The increased thermal resistance significantly reduces the heat-dissipating speed of the working fluid in the condensing section 60 of the heat pipe to ambient environment and ultimately limits the heat transfer performance of the heat pipe.

Therefore, it is desirable to provide a heat pipe with wick of graduated thickness that can provide a satisfactory rate of heat dissipation for the working fluid in the condensing section 60 of the heat pipe and a reduced thermal resistance to the condensed liquid.

SUMMARY OF THE INVENTION

A heat pipe in accordance with a preferred embodiment of the present invention includes a casing containing a working fluid therein and a capillary wick arranged in an inner wall of the casing. The casing includes an evaporating section at one end thereof and a condensing section at an opposite end thereof, and a central section located between the evaporating section and the condensing section. The capillary wick formed at the condensing section is thinner than the capillary wick formed at the central and evaporating sections. The capillary wick is capable of reducing the thermal resistance between the working fluid and the casing at the condensing section.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
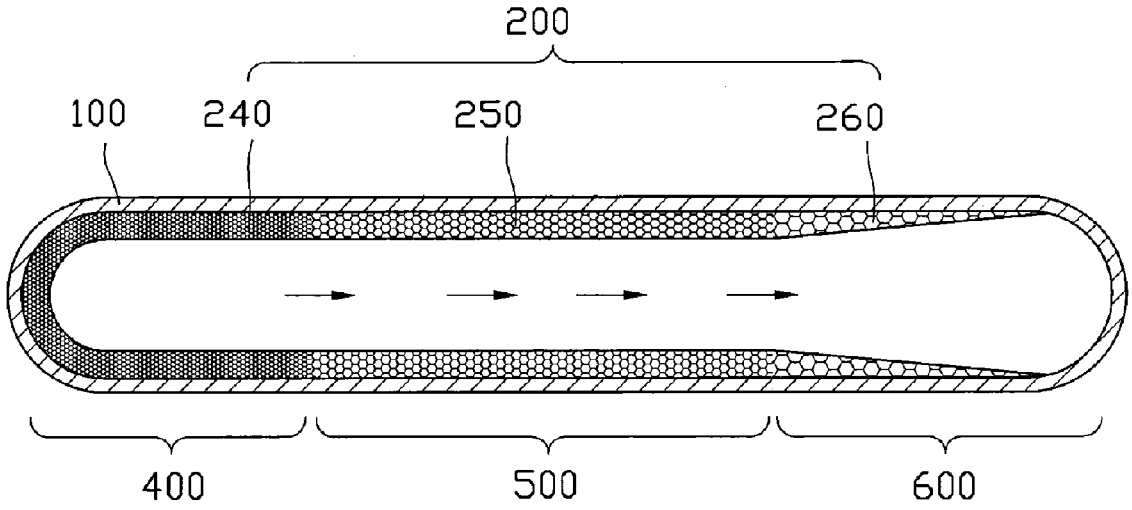
FIG. 1 is a longitudinal cross-sectional view of a heat pipe in accordance with a first embodiment of the present invention.

FIG. 1 illustrates a heat pipe in accordance with a first embodiment of the present invention. The heat pipe comprises a casing 100 and a capillary wick 200 arranged at an inner surface of the casing 100. The casing 100 comprises an evaporating section 400 and a condensing section 600 at an opposite end thereof, and a central (adiabatic) section 500 located between the evaporating section 400 and the condensing section 600. The casing 100 is made of highly thermally conductive materials such as copper or copper alloys and filled with a working fluid (not shown), which acts as a heat carrier for carrying thermal energy from the evaporating section 400 to the condensing section 600 where it can undergo a phase transition from a liquid state to a vaporous state. Heat that needs to be dissipated is transferred firstly to the evaporating section 400 of the casing 100 to cause the working fluid to evaporate. Then, the heat is carried by the working fluid in the form of vapor to the condensing section 600 where the heat is released to ambient environment, thus condensing the vapor into liquid. The condensed liquid is then brought back via the capillary wick 200 to the evaporating section 400 where it is again available for evaporation.

The wick structures currently available for conventional heat pipes include fine grooves integrally formed at the inner wall of the heat pipes, screen mesh or bundles of fiber inserted into the heat pipes and held against the inner wall, or sintered powder combined to the inner wall of the heat pipes through a sintering process. The capillary wick 200 can be a groove-type wick, a sintered-type wick or a meshed-type wick. Pore sizes of the capillary wick 200 gradually increase from the evaporating section 400 to the condensing section 600 of the casing 100. Along a radial direction of the casing 100, the capillary wick 200 has a graduated thickness. The capillary wick 200 comprises a first capillary wick 240 formed at the evaporating section 400 of the casing 100, a second capillary wick 250 formed at the central section 500 of the casing 100 and a third capillary wick 260 formed at the condensing section 600 of the casing 100. A thickness of the third capillary wick 260 at the condensing section 600 gradually decreases towards an extreme end of the casing 100 remote from the evaporating section 400 along a lengthwise direction of the casing 100. Heat exchange speed between the vapor and the inner wall of the casing 200 is greatly improved and the heat transfer efficiency of the heat pipe is improved as a result. The thicknesses of the first and second capillary wick 240, 250 in a radial direction of the casing 100 are equal, and equal to the thickest point of the third capillary wick 260 in the radial direction of the casing 100.

Figure 2:
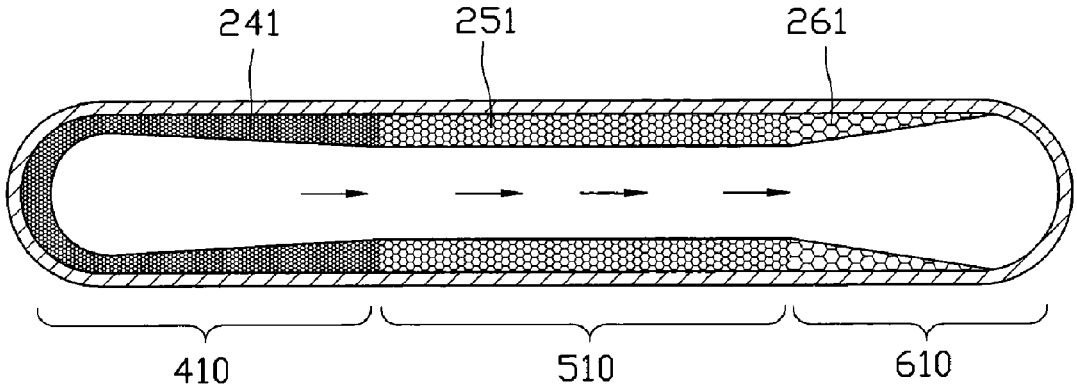
FIG. 2 is a longitudinal cross-sectional view of a heat pipe in accordance with a second embodiment of the present invention.

FIG. 2 illustrates a heat pipe in accordance with a second embodiment of the present invention. The heat pipe comprises an evaporating section 410 at an end thereof, a condensing section 610 at an opposite end thereof, and a central section 510 located between the evaporating section 410 and the condensing section 610. First, second and third capillary wicks 241, 251 and 261 are formed at the evaporating, central and condensing sections 410, 510 and 610 respectively. The first capillary wick 241 is designed to have a changeable section in a radial direction of the heat pipe on the base of the first embodiment of the present invention. The first capillary wick 241 gradually increases in thickness towards the condensing section 610 in a lengthwise direction of the heat pipe. An average thickness of the first capillary wick 241 in the evaporating section 410 is bigger than that of the third capillary wick 260 at the condensing section 610. The average thickness of the first capillary wick 241 is such that working fluid may be evaporated rapidly through heat absorption. The thickness of the thickest point of the first capillary wick 241 at the evaporating section 410 and the third capillary wick 261 at the condensing section 610 is the same and is also equal to a thickness of the second capillary wick 251 formed at the central section 510. The third capillary wick 261 has a structure the same as that of the third capillary wick 260 of the first embodiment.

Figure 3:
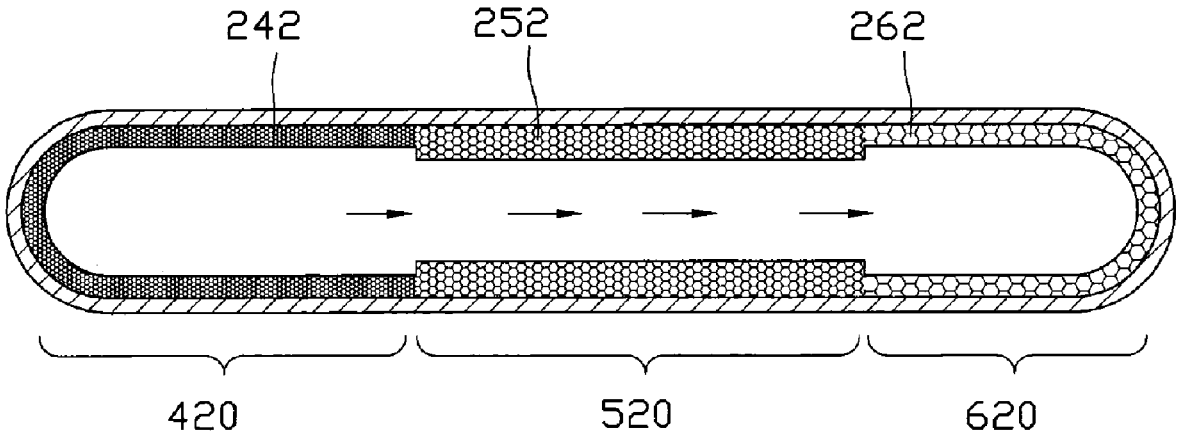
FIG. 3 is a longitudinal cross-sectional view of a heat pipe in accordance with a third embodiment of the present invention.

FIG. 3 illustrates a heat pipe in accordance with a third embodiment of the present invention. The heat pipe comprises an evaporating section 420 at one end thereof, a condensing section 620 at an opposite end thereof, and a central section 520 located between the evaporating section 420 and the condensing section 620. First, second and third capillary wicks 242, 252 and 262 are formed at the evaporating, central and condensing sections 420, 520 and 620 respectively. Main differences between the second and third embodiments are that the thickness of the first capillary wick 242 at the evaporating section 420 and the third capillary wick 262 at the condensing section 620 are uniform. Each of the first and third capillary wicks 242 and 262 has a difference in thickness with the second capillary wick 252 formed at the central section 520. The second capillary wick 252 is thicker than the first and third capillary wicks 242, 262.

Figure 4:
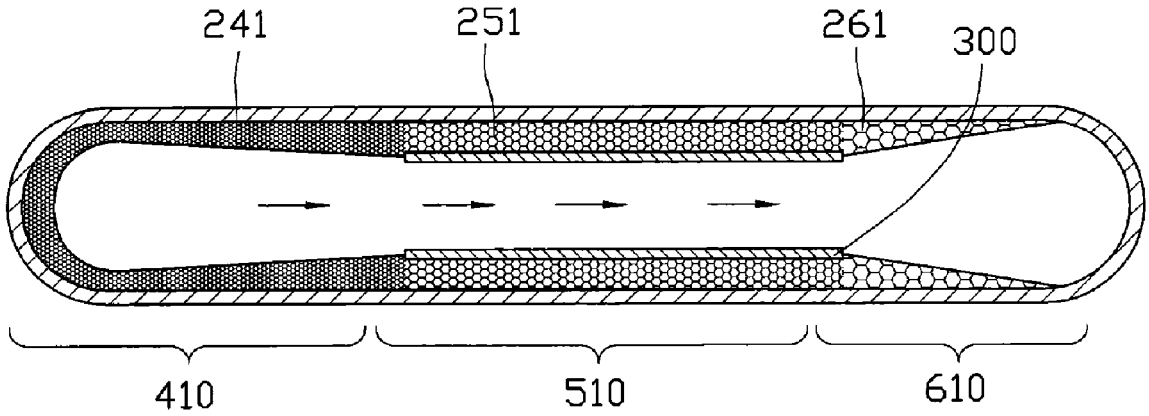
FIG. 4 is a longitudinal cross-sectional view of a heat pipe in accordance with a fourth embodiment of the present invention.
Figure 5:
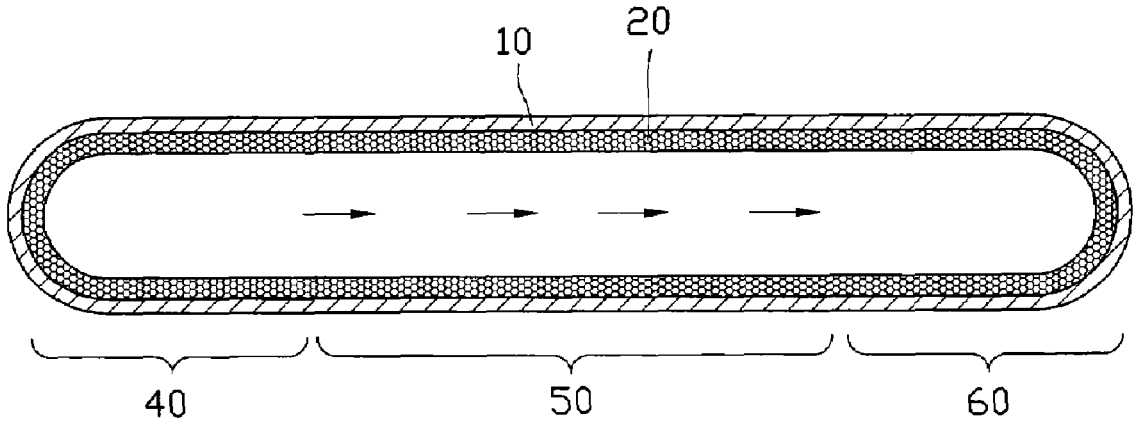
FIG. 5 (RELATED ART)
FIG. 5 is a longitudinal cross-sectional view of a heat pipe in accordance with related art.

FIG. 4 illustrates a heat pipe in accordance with a fourth embodiment of the present invention. A thin tube 300 is disposed at the central section 510 of the heat pipe on the base of the second embodiment of the present invention to separate the evaporated working fluid from the liquid working fluid at the central section 510. An entrainment limit caused by contra-flow between the different ends of the heat pipe can therefore be avoided. Heat transfer performance of the heat pipe is improved. The tube 300 is attached on an inner surface of the second capillary wick 251 at the central section 510. The tube 300 is of a thin film, meshed, metallic or nonmetallic material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a metal casing containing a working fluid therein, the casing comprising an evaporating section and a condensing section at an opposite end thereof, and a central section located between the evaporating section and the condensing section; and a capillary wick arranged at an inner surface of the casing; wherein a thickness of the capillary wick formed at the condensing section in a radial direction of the casing is smaller than that of the capillary wick formed in the central section of the casing;

wherein the thickness of the capillary wick formed at the condensing section gradually decreases towards an extreme end of the metal casing remote from the evaporating section in a lengthwise direction of the casing;

wherein the thickness of the capillary wick formed at the evaporating section gradually increases towards the condensing section in a lengthwise direction of the casing; and wherein an average thickness of the capillary wick formed at the evaporating section is greater than that of the capillary wick formed at the condensing section.

2. The heat pipe of claim 1, wherein pore sizes of the capillary wick gradually increase from the evaporating section to the condensing section of the casing.

3. The heat pipe of claim 1, wherein the capillary wick is a grooved-type wick.

4. The heat pipe of claim 1, wherein the capillary wick is a sintered-type wick.

5. A heat pipe comprising:

working fluid;

a metal casing receiving the working fluid therein and divided into an evaporating section, a condensing section and a central section between the evaporating and condensing sections;

a wick structure attached to an inner wall of the metal casing, having a pore size gradually increased from the evaporating section toward the condensing section; wherein the wick structure at the condensing section has an average thickness which is smaller than that at the central section;

wherein the wick structure at the condensing section has a gradually decreased thickness along a direction from the evaporating section toward the condensing section; and wherein the wick structure at the evaporating section has a gradually increased thickness along the direction from the evaporating section toward the condensing section.

* * * * *